US007765809B2

(12) United States Patent
Brown et al.

(10) Patent No.: US 7,765,809 B2
(45) Date of Patent: Aug. 3, 2010

(54) COMBUSTOR DOME AND METHODS OF ASSEMBLING SUCH

(75) Inventors: Daniel Dale Brown, Cincinnati, OH (US); Michael Terry Bucaro, Liberty Township, OH (US)

(73) Assignee: General Electric Company, Schenectady, NY (US)

( * ) Notice: Subject to any disclaimer, the term of this patent is extended or adjusted under 35 U.S.C. 154(b) by 936 days.

(21) Appl. No.: 11/558,636

(22) Filed: Nov. 10, 2006

(65) Prior Publication Data

US 2008/0110174 A1 May 15, 2008

(51) Int. Cl.
*F02C 1/00* (2006.01)
*F02G 3/00* (2006.01)

(52) U.S. Cl. ..... 60/752; 60/796

(58) Field of Classification Search ..... 60/796, 60/798, 800, 752, 804
See application file for complete search history.

(56) References Cited

U.S. PATENT DOCUMENTS

| | | | | |
|---|---|---|---|---|
| 3,854,285 | A | 12/1974 | Stenger et al. | |
| 4,232,527 | A | 11/1980 | Reider | |
| 5,237,820 | A | 8/1993 | Kastl et al. | |
| 5,239,832 | A * | 8/1993 | Koshoffer et al. | 60/740 |
| 5,323,604 | A | 6/1994 | Ekstedt et al. | |
| 5,524,430 | A * | 6/1996 | Mazeaud et al. | 60/798 |
| 5,630,319 | A | 5/1997 | Schilling et al. | |
| 5,865,024 | A | 2/1999 | Kress et al. | |
| 6,314,739 | B1 | 11/2001 | Howell et al. | |
| 6,334,298 | B1 | 1/2002 | Aicholtz | |
| 6,427,435 | B1 * | 8/2002 | Patterson et al. | 60/800 |
| 6,449,952 | B1 * | 9/2002 | Emilianowicz et al. | 60/772 |
| 6,502,400 | B1 | 1/2003 | Freidauer et al. | |
| 6,672,067 | B2 * | 1/2004 | Farmer et al. | 60/752 |
| 6,725,667 | B2 | 4/2004 | Farmer et al. | |
| 6,779,268 | B1 * | 8/2004 | Farmer | 29/890.01 |
| 6,976,363 | B2 | 12/2005 | McMasters et al. | |
| 7,062,920 | B2 | 6/2006 | McMasters et al. | |
| 7,121,095 | B2 * | 10/2006 | McMasters et al. | 60/746 |
| 7,415,826 | B2 * | 8/2008 | McMasters et al. | 60/748 |
| 2008/0110022 | A1 * | 5/2008 | Brown et al. | 29/889.2 |

* cited by examiner

*Primary Examiner*—William H Rodríguez
(74) *Attorney, Agent, or Firm*—William Scott Andes, Esq.; Armstrong Teasdale LLP

(57) ABSTRACT

A method of assembling a dome assembly for use in a turbine engine combustor is disclosed. The method includes providing a dome assembly ring, an inner liner portion, and an outer liner portion. The method also includes coupling the inner liner portion and the outer liner portion to the dome assembly ring, positioning a plurality of rings on the dome assembly ring, and coupling at least one of an inner cowl and an outer cowl to the dome assembly ring such that each of the plurality of rings and at least one of the inner and outer cowls are removable without uncoupling the dome assembly ring from either the inner or outer liner portions.

18 Claims, 7 Drawing Sheets

COMBUSTOR DOME AND METHODS OF ASSEMBLING SUCH

BACKGROUND OF THE INVENTION

This invention relates generally to gas turbines, and more particularly, to combustor domes used in turbine engines.

At least some known gas turbine engines use a lean domed combustor that includes a center mixer assembly integral to a fuel nozzle and a dome-mounted mixer assembly that forms a portion of a dome assembly. Known dome-mounted mixer assemblies are not rigidly mounted to the dome, but rather are free to move. Because the dome-mounted mixer assembly is free to move, generally such mixer assemblies are not compatible with standard combustor assembly processes.

One known method of assembling combustors using such mixer assemblies includes positioning the dome in the combustor assembly using a mixer feature that is fixed without a float. More specifically, during assembly, all major subassembly positions are set in one operation, and then bolts are installed and tightened to maintain the components in position. However, combustors assembled using such methods do not permit the mixers or cowls to be replaced without the dome or liners being disassembled. As a result, maintenance of such combustors may be a timely, difficult, and expensive task.

BRIEF DESCRIPTION OF THE INVENTION

In one aspect, a method of assembling a dome assembly for use in a turbine engine combustor is disclosed. The method includes providing a dome assembly ring, an inner liner portion, and an outer liner portion. The method also includes coupling the inner liner portion and the outer liner portion to the dome assembly ring, positioning a plurality of elongated rings on the dome assembly ring and coupling at least one of an inner cowl and an outer cowl to the dome assembly ring such that each of the plurality of elongated rings and at least one of the inner and outer cowls are removable without uncoupling the dome assembly ring from either the inner or outer liner portions.

In another aspect, a system for assembling a dome assembly for use in a turbine engine combustor is disclosed. The system includes a dome assembly ring, an inner liner portion and an outer liner portion. The inner liner portion and the outer liner portion are coupled to the dome assembly ring to form a partially-assembled dome assembly. The system also includes a plurality of elongated rings, each of the plurality of elongated rings being coupled to the dome assembly ring, and at least one of an inner cowl and an outer cowl being coupled to the partially-constructed dome assembly such that each of the plurality of elongated rings and at least one of the inner and outer cowls is removable without uncoupling the partially-assembled dome assembly from either the inner or outer liner portions.

In yet another aspect, a dome assembly for use in a turbine engine combustor is disclosed. The dome assembly includes a dome assembly ring, an inner liner portion, and an outer liner portion. The inner liner portion and the outer liner portion are coupled to the dome assembly ring to form a partially-assembled dome assembly. The assembly also includes a plurality of elongated rings, each of the plurality of elongated rings is coupled to the dome assembly ring, and at least one of an inner cowl and an outer cowl is coupled to the partially-constructed dome assembly such that each of the plurality of elongated rings and at least one of the inner and outer cowls is removable without uncoupling the partially-assembled dome assembly from either the inner or outer liner portions.

DETAILED DESCRIPTION OF THE INVENTION

Figure 1:
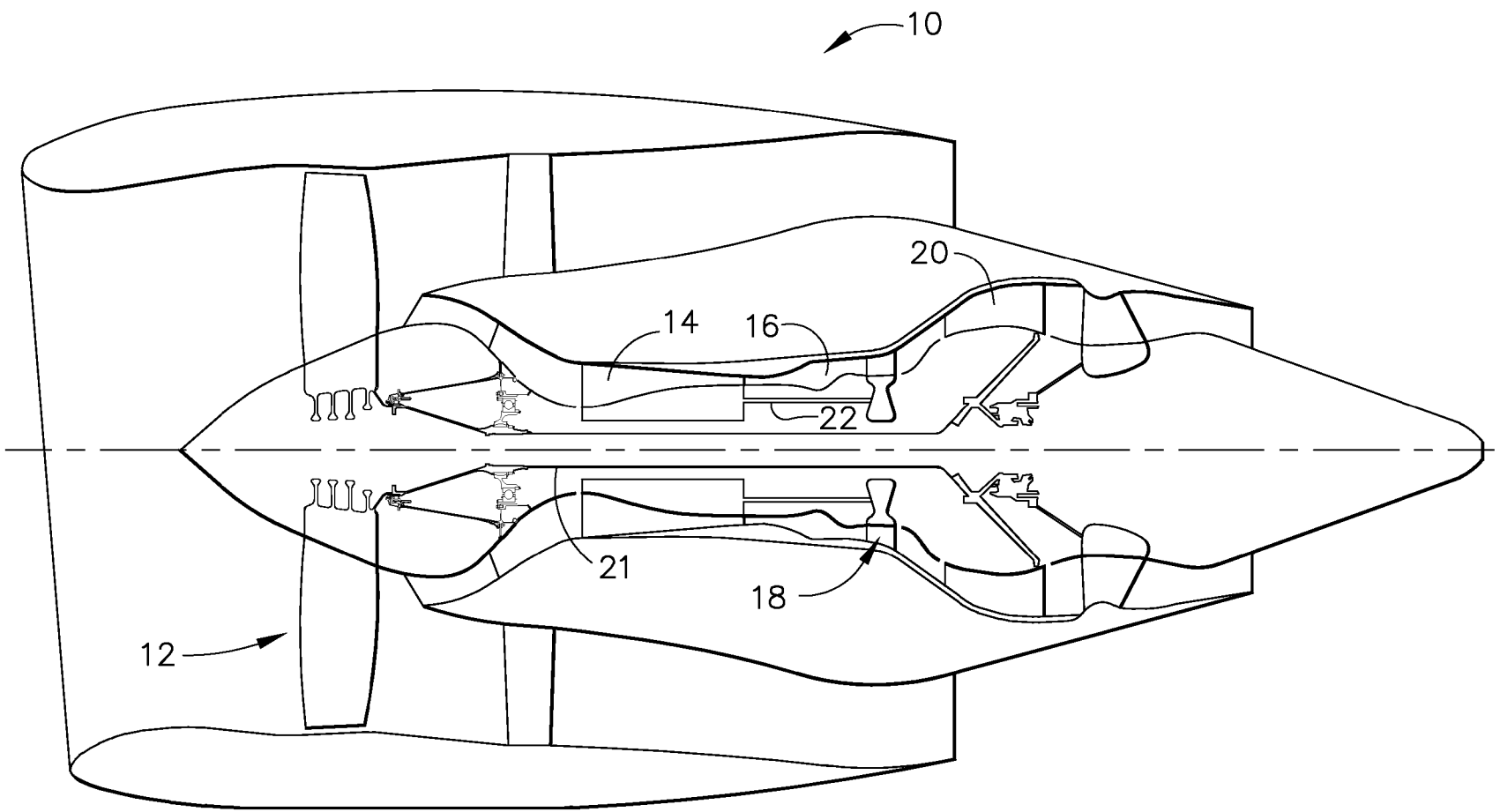
FIG. 1 is a schematic illustration of an exemplary turbine engine.

FIG. 1 is a schematic illustration of an exemplary gas turbine engine 10. Engine 10 includes a low pressure compressor 12, a high pressure compressor 14, and a combustor assembly 16. Engine 10 also includes a high pressure turbine 18, and a low pressure turbine 20 arranged in a serial, axial flow relationship. Compressor 12 and turbine 20 are coupled by a first shaft 21, and compressor 14 and turbine 18 are coupled by a second shaft 22. In the exemplary embodiment, gas turbine engine 10 is a CFM56 gas turbine engine or CF34-10 that are available from General Electric Company, Cincinnati, Ohio.

Figure 2:
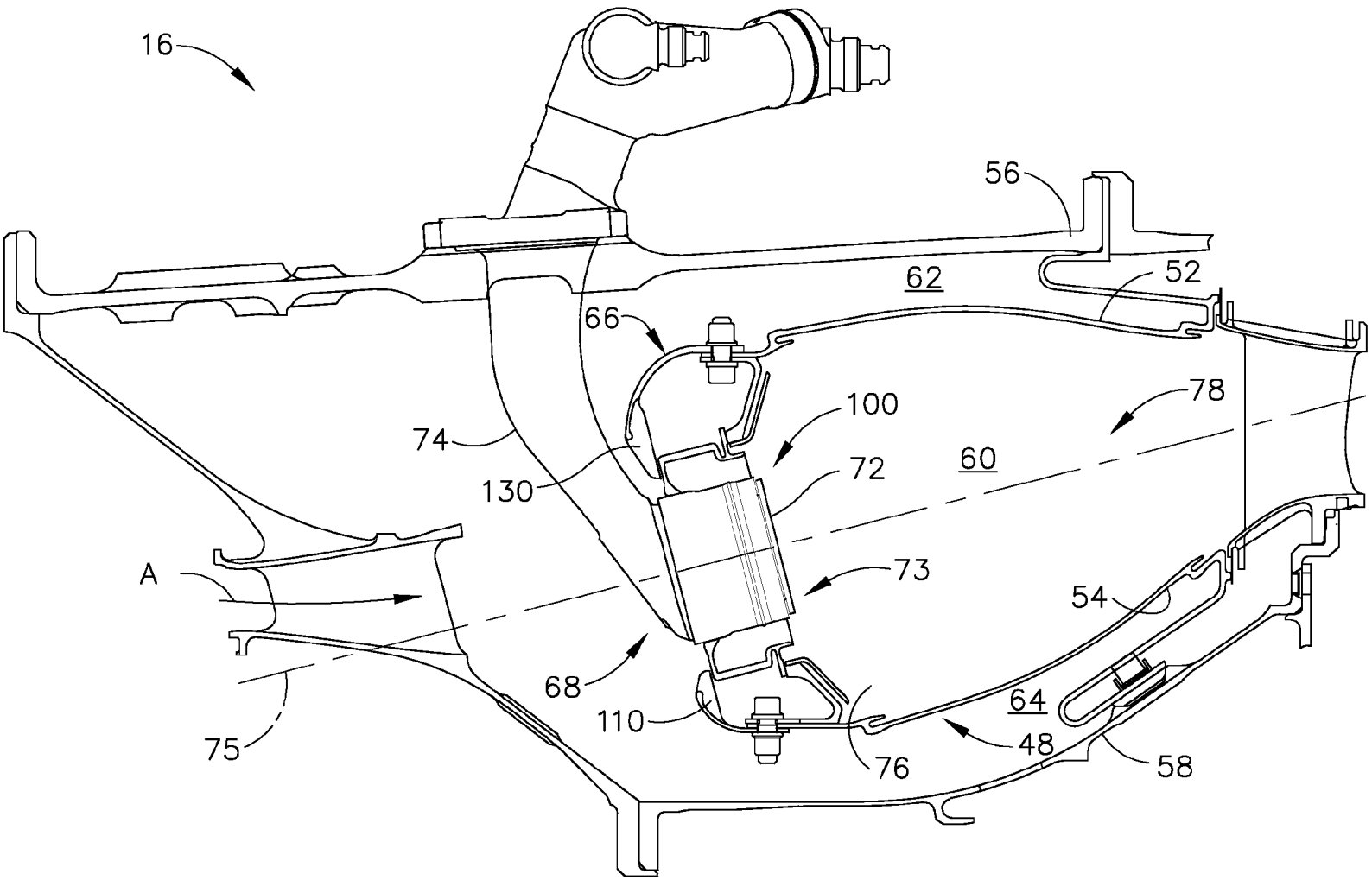
FIG. 2 is a schematic cross-sectional view of an exemplary combustor that may be used with the turbine engine shown in FIG. 1.

FIG. 2 is a schematic cross-sectional view of an exemplary combustor 16 that may be used with gas turbine engine 10 (shown in FIG. 1). Combustor 16 includes an outer liner 52 and an inner liner 54 disposed between an outer combustor casing 56 and an inner combustor casing 58. Outer and inner liners 52 and 54 are spaced radially from each other such that a combustion chamber 60 is defined therebetween. Outer liner 52 and outer casing 56 form an outer passage 62 therebetween, and inner liner 54 and inner casing 58 form an inner passage 64 therebetween. A cowl assembly 66 is coupled to the upstream ends of outer and inner liners 52 and 54, respectively. An annular opening 68 formed in cowl assembly 66 enables compressed fluid entering combustor 16 through a diffuse opening in a direction generally indicated by arrow A. The compressed fluid flows through annular opening 68 to support combustion and to facilitate cooling liners 52 and 54. It should be appreciated that the term "fluid" as used herein includes any material, substance or medium that flows, including, but not limited to, gas and air.

An annular dome assembly 100 extends between, and is coupled to, outer and inner liners 52 and 54 near their upstream ends. Each swirler assembly 72 receives compressed air from opening 68 and fuel from a corresponding fuel injector 74. Fuel and air are swirled and mixed together by swirler assemblies 72, and the resulting fuel/air mixture is discharged into combustion chamber 60. Combustor 16 includes a longitudinal axis 75 which extends from a forward end 76 to an aft end 78 of combustor 16. In the exemplary embodiment, combustor 16 is a single annular combustor. Alternatively, combustor 16 may be any other combustor, including, but not limited to a double annular combustor.

Figure 3:
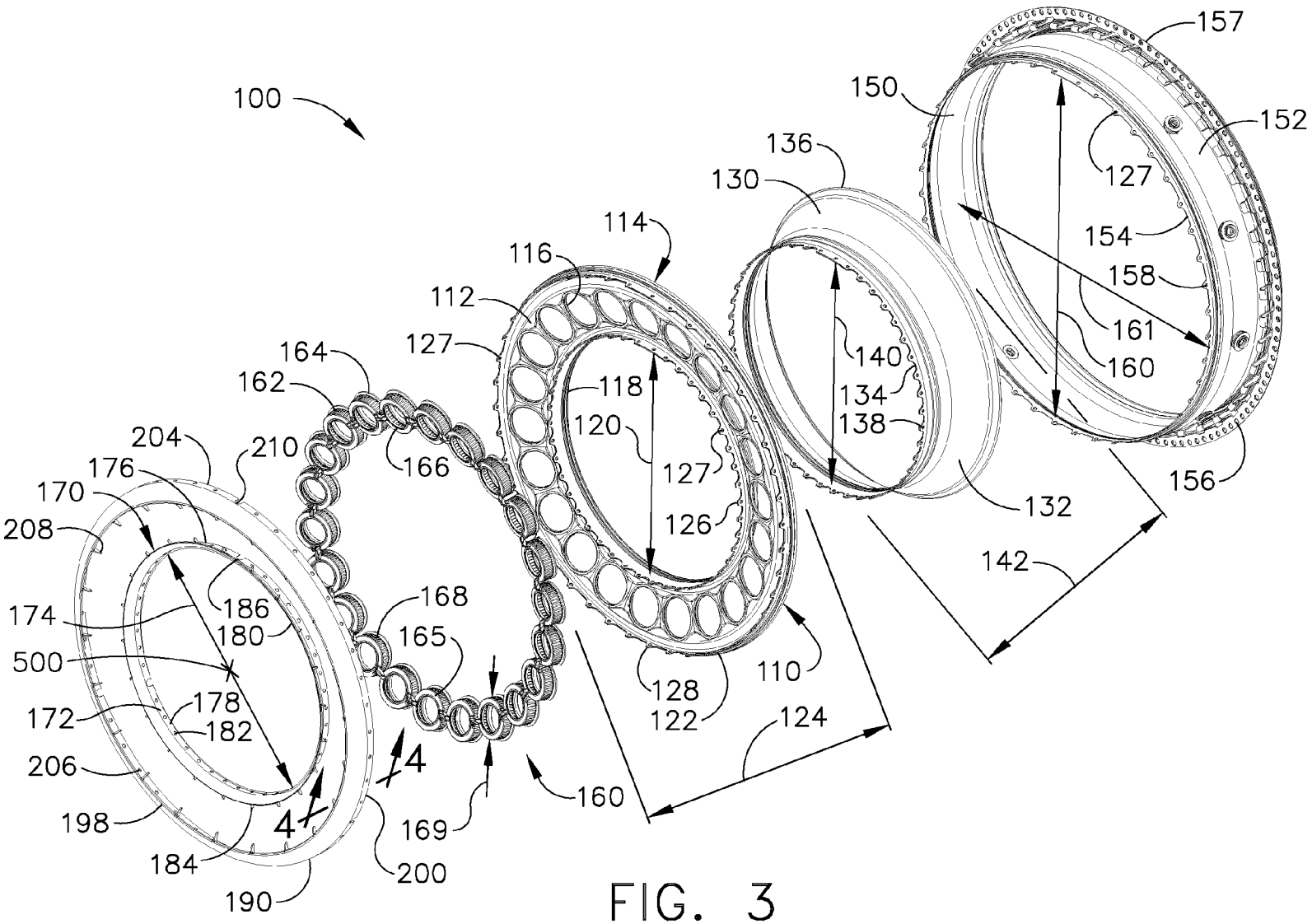
FIG. 3 is an exploded view of an exemplary dome assembly that can be used with the combustor shown in FIG. 2.

FIG. 3 is an exploded view of annular dome assembly 100 shown in FIG. 2. In the exemplary embodiment, dome assembly 100 includes a dome assembly ring 110, an inner liner portion 130, an outer liner portion 150, a plurality of mixers 160, an inner cowl 170, and an outer cowl 190. Dome assembly ring 110 has an annular configuration that includes a front face 112 and a rear face 114 opposite front face 112. Additionally, assembly ring 110 includes a plurality of circumferentially-spaced circular openings 116, an assembly ring inner edge 118 that defines a ring inner diameter 120, and an assembly ring outer edge 122 that defines a ring outer diameter 124. Assembly ring inner edge 118 includes a plurality of circumferentially and uniformly spaced tabs 126 extending therefrom. Similarly, assembly ring outer edge 122 includes a plurality of circumferentially and uniformly spaced tabs 128 extending therefrom. In the exemplary embodiment, each tab 126 and 128 has an opening 127 extending therethrough.

In the exemplary embodiment, inner liner portion 130 has an inner liner portion diameter 140 that varies across a body portion 132. Moreover, portion 130 includes body portion 132, a first flange 134, and a second flange 136. First flange 134 extends outward from body portion 132 and includes a plurality of circumferentially and uniformly spaced tabs 138. Flange 134 has an inner liner portion diameter 140 that is smaller than assembly ring inner diameter 120. Second flange 136 extends outward from body portion 132 and has an inner diameter 142 that is larger than inner liner portion diameter 140. Body portion 132 tapers gradually from first flange 134 to second flange 136, wherein each flange 134 and 136 defines an outer limit of body portion 132. A diameter of body portion 132 between flanges 134 and 136 varies across body portion 132. In the exemplary embodiment, tabs 138 have openings 127 extending therethrough.

Outer liner portion 150 is cylindrically-shaped and includes a body portion 152, a first flange 154, and a second flange 156. First flange 154 includes a plurality of circumferentially and uniformly spaced tabs 158 and has a diameter 160 that is larger than assembly ring outer diameter 124. Second flange 156 includes a plurality of circumferentially and uniformly spaced openings 157 formed therein. Body portion 152 tapers gradually from first flange 154 to second flange 156, such that an inner diameter 161 of portion 150 varies along body portion 150. Moreover, body portion 152 includes a plurality of openings 153, and tabs 158 each include an opening 127 extending therethrough.

Mixers 160 include a plurality of swirlers 162, that are each sized and shaped to correspond to each of the plurality of openings 116 of assembly ring 110. More specifically, each swirler 162 is configured as an elongated ring having a first circular end 164, a second circular end 166, and a plurality of circumferentially and uniformly spaced members 168 extending therebetween. Moreover, each swirler 162 defines an opening 165 having a diameter 169. It should be appreciated that members 168 may be any length and opening 165 may have any diameter 169 that enables dome assembly 100 to function as described herein. Although the exemplary embodiment describes swirlers 162 as having a circular cross-section that is sized and shaped to correspond to openings 116, other embodiments may use swirlers 162 having any shape or size that enables mixers 160 to function as described herein.

Inner cowl 170, in the exemplary embodiment, is annular and has an arcuate cross section. Moreover, inner cowl 170 has an inner surface 172 that defines an inner cowl diameter 174. In addition, inner cowl 170 also includes an outer surface 176. Inner surface 172 extends from a first edge 178 to a second edge 180, and includes a plurality of circumferentially and uniformly spaced openings 182. Moreover, a plurality of protrusions 184 extend outward from inner cowl outer surface 176. In the exemplary embodiment, first edge 178 includes three slots 186 that extend inwardly from a first edge 178 partially towards second edge 180. It should be appreciated that although the exemplary embodiment is described as having only three slots 186, other embodiments may include any number of slots 186 that enables dome assembly 100 to function as described herein. Further, it should be appreciated that slots 186 may extend any distance from edge 178 towards edge 180 that enables dome assembly 100 to function as described herein.

Figure 4:
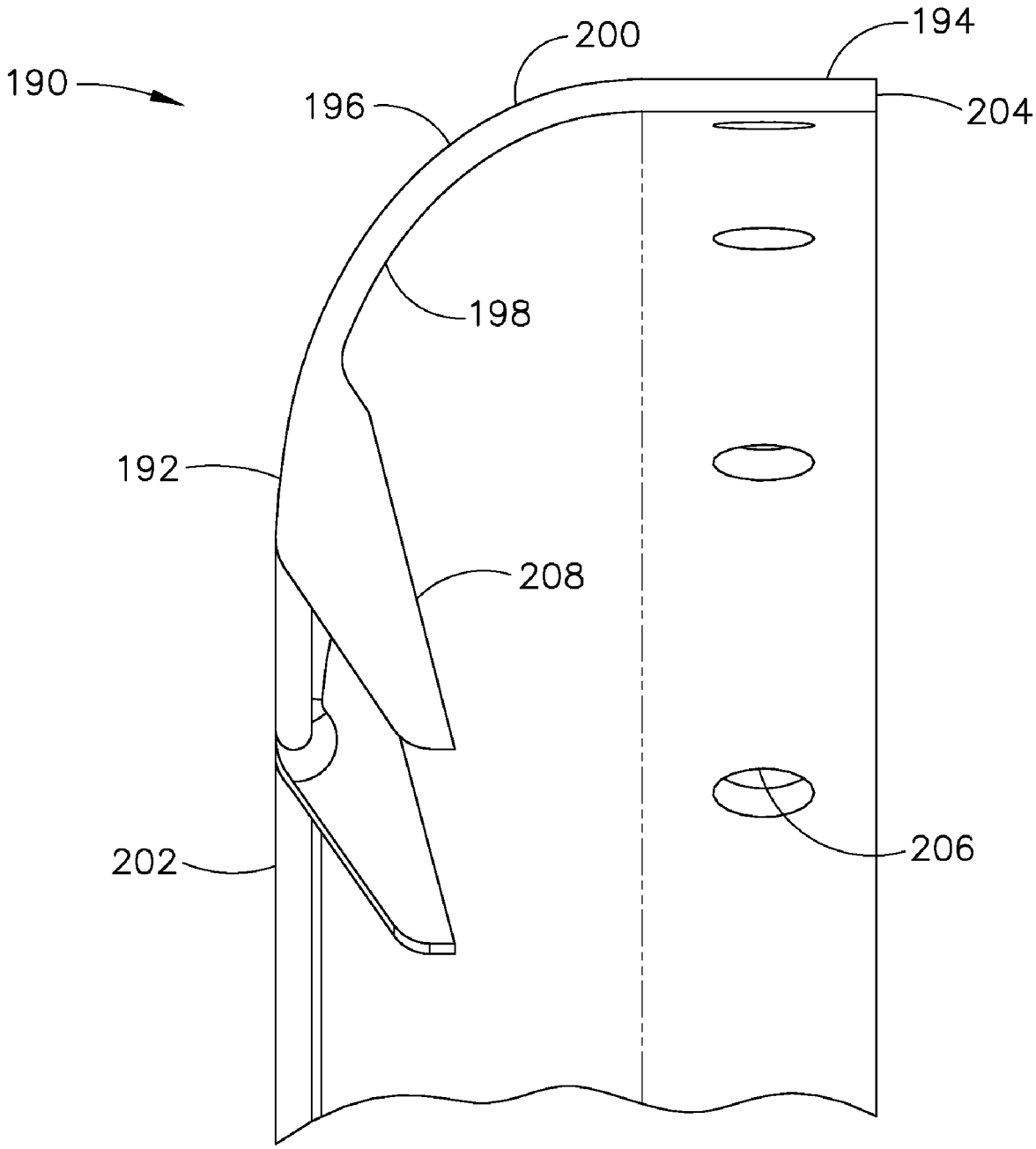
FIG. 4 is a cross-sectional view of an outer cowl shown in FIG. 3 and taken along line 4-4.

FIG. 4 is a cross-sectional view of outer cowl 190. In the exemplary embodiment, outer cowl 190 is annular and includes a first leg 192, a second leg 194, and an arcuate body 196 extending therebetween. Outer cowl 190 includes an inner surface 198 and an opposite outer surface 200. Furthermore, outer cowl 190 extends from a first edge 202 to a second edge 204 and includes a plurality of circumferentially and uniformly spaced openings 206 therebetween. Moreover, outer cowl 190 also includes a plurality of protrusions 208 that extend away from cowl inner surface 198 towards a center 500 of outer cowl 190. In the exemplary embodiment, first edge 202 includes three slots 210 that extend from cowl second edge 204 towards a center of body 196 and are positioned to correspond to or substantially align with slots 186 of inner cowl 170. It should be appreciated that although the exemplary embodiment illustrates cowl 190 having only three slots 210, other embodiments may include any number of slots 210 that enables dome assembly 100 to function as described herein. Further, it should be appreciated that slots 210 may extend any distance from second edge 204 through body 196 that enables dome assembly 100 to function as described herein.

Figure 5:
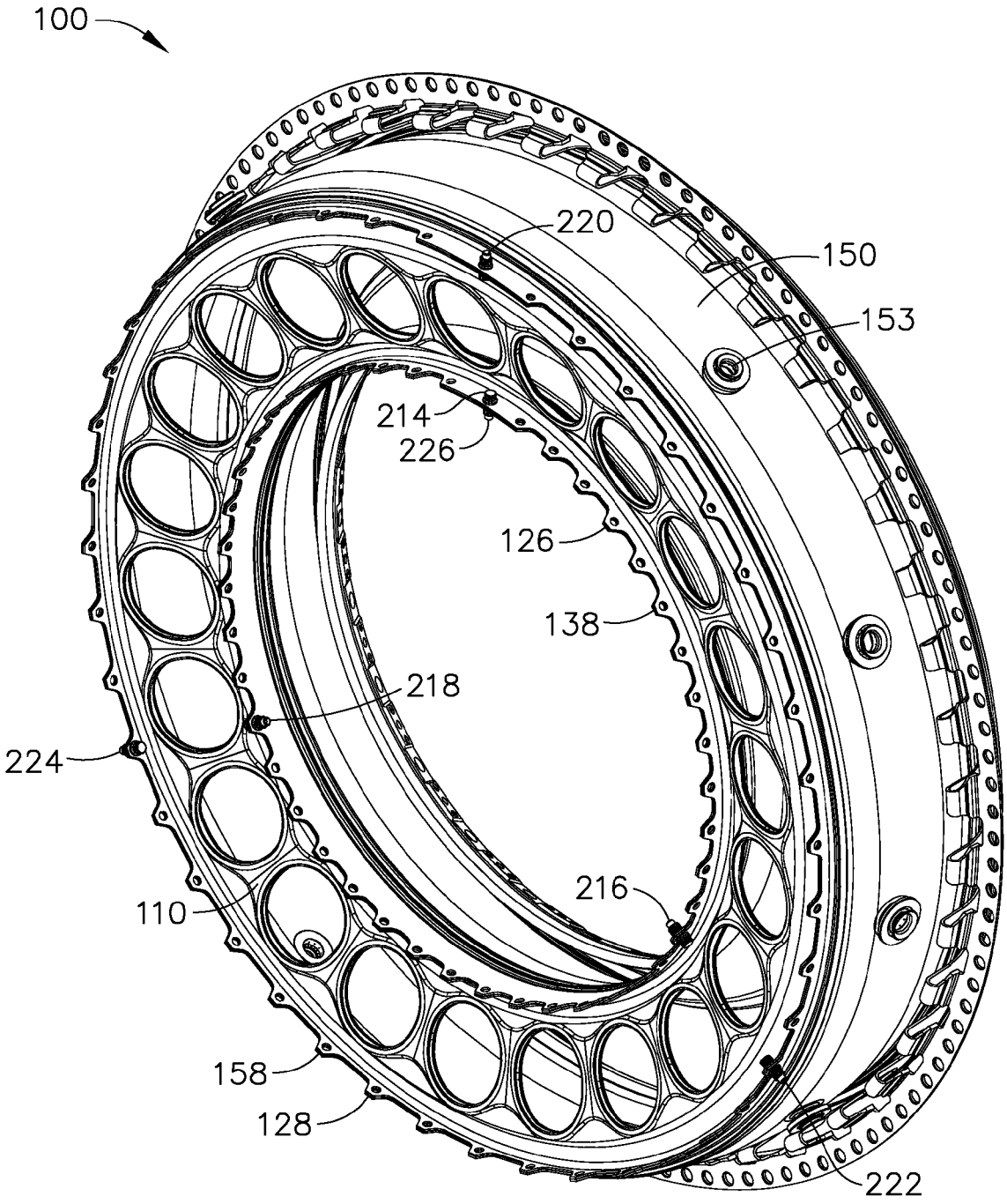
FIG. 5 is a perspective view of the dome assembly shown in FIG. 3 and in a subsequent stage of assembly.

FIG. 5 is a perspective view of dome assembly 100 in a subsequent stage of assembly. In the exemplary embodiment, during a first stage of assembly, inner liner portion 130 and outer liner portion 150 are each coupled to assembly ring 110. Specifically, with respect to inner liner portion 130, tabs 138 are each substantially aligned with a respective tab 126 of assembly ring 110. Three of the aligned pairs of tabs, identified as pairs 214, 216 and 218, are mechanically coupled together using fastening means 226. In the exemplary embodiment, fastening means 226 are threaded bolts. With respect to outer liner portion 150, tabs 158 are each substantially aligned with a respective tab 128 of assembly ring 110. Three of the aligned pairs of tabs, identified as tab pairs 220, 222 and 224, are mechanically coupled together using bolts 226. It should be understood that tab pairs 214, 216, and 218 corresponding to inner liner portion 130, are substantially radially aligned with respective tab pairs 220, 222 and 224 of outer liner portion 150. It should be appreciated that although the exemplary embodiment describes inner liner tab pairs 214, 216 and 218 as substantially radially aligning with outer liner tab pairs 220, 222 and 224, respectively, other embodiments may define inner tab pairs 214, 216 and 218 and outer tab pairs 220, 222 and 224 that do not substantially radially align. Moreover, it should be appreciated that although the exemplary embodiment is described as coupling only three tab pairs 214, 216, and 218 together along inner portion 130, and three pairs 220, 222 and 224 together along outer liner portion 150, in other embodiments, any number of tab pairs may be coupled together that enables dome assembly 100 to function as described herein. Furthermore, it should be appreciated that although the exemplary embodiment is described as using bolts 226 to mechanically couple tab pairs 214, 216, 218, 220, 222 and 224 together, other embodiments may use any type of coupling means that enables dome assembly 100 to function as described herein. After coupling inner liner portion 130 and outer liner portion 150 to assembly ring 110, the partially constructed dome assembly 100 is positioned in combustor 16.

Figure 6:
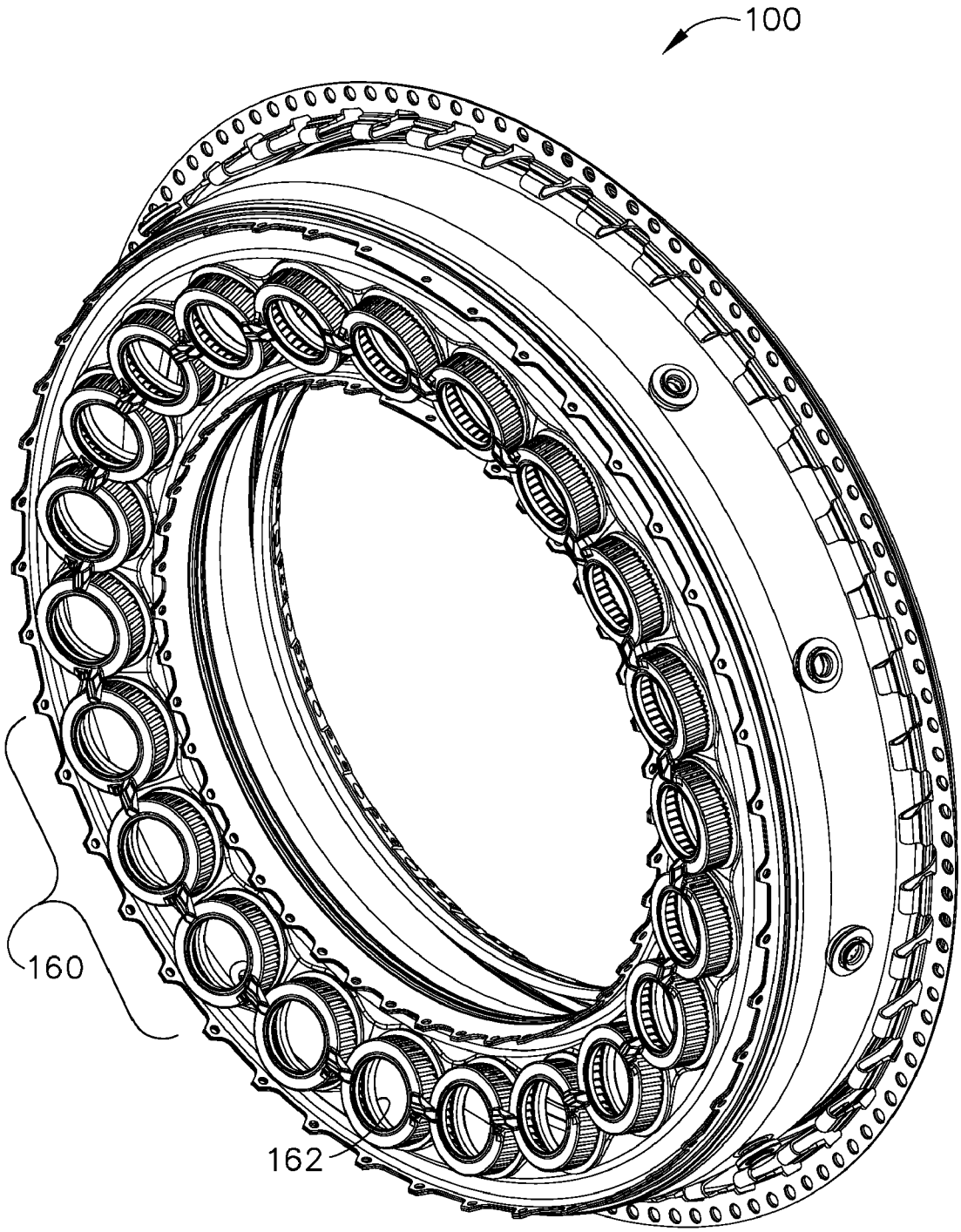
FIG. 6 is a perspective view of the partially assembled dome assembly shown in FIG. 5 and in a further stage of assembly.
Figure 7:
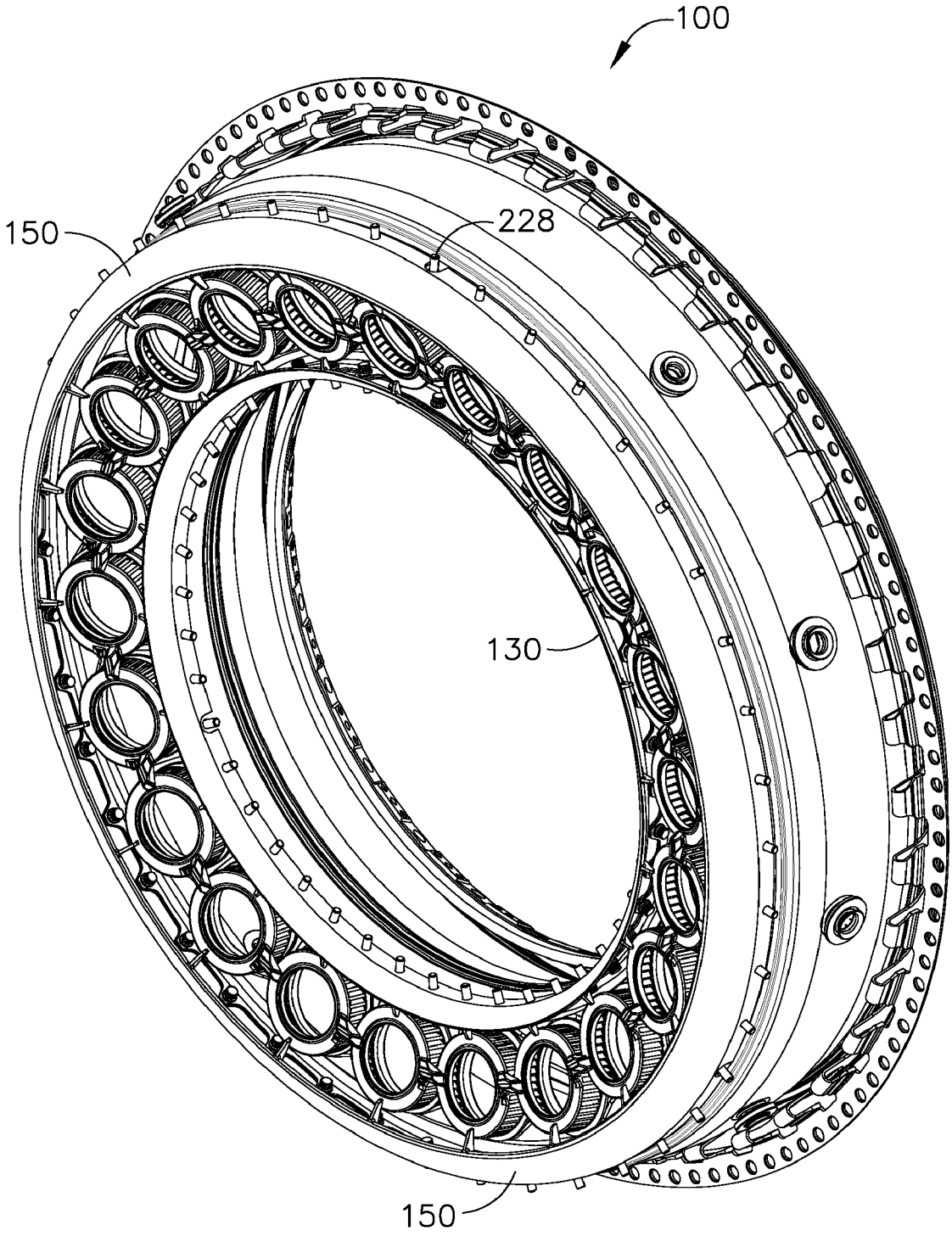
FIG. 7 is a perspective view of a completely assembled dome assembly shown in FIG. 6.

FIG. 6 is a perspective view of dome assembly 100 in a subsequent stage of assembly. FIG. 7 is a perspective view of a completely assembled dome assembly 100. In the exemplary embodiment, during this stage of assembly, each of the plurality of elongated swirlers 162 is substantially aligned with a respective one of the openings 116 defined in dome assembly ring 110. More specifically, first circular end 164 of each swirler 162 is positioned against front face 112 of assembly ring 110 such that opening 165 concentrically aligns with a corresponding opening 116 of assembly ring 110. It should be appreciated that although the exemplary embodiment describes concentrically aligning the respective openings 165 and 116, other embodiments may align openings 165 and 116 in any manner that enables dome assembly 100 to function as described herein. Swirlers 162 may be coupled to assembly ring 110 by brazing or welding. It should be appreciated that other embodiments may couple swirlers 162 to assembly ring 110 in any manner that enables dome assembly 100 to function as described herein.

Inner and outer cowls 170 and 190, respectively, are then coupled to assembly ring 110. With respect to inner cowl 170, each inner cowl slot 186 is substantially aligned with one tab pair 214, 216 or 218. More specifically, when slots 186 are aligned with tab pairs 214, 216 and 218, each protrusion 184 of inner cowl 170 is substantially aligned with one of the swirlers 162 and ring tabs 126 are also substantially aligned with inner cowl openings 182. As such, inner cowl 170 can be mechanically coupled to dome assembly ring 110 using, for example, bolts 226. More specifically, when cowl 170 is aligned with respect to assembly ring 110, a bolt 226 is inserted through each tab 126 and opening 182 interface such that inner cowl 170 is securely coupled to dome assembly ring 110 and to liner portions 130 and 150. Moreover, a cowl scallop 228 is used to couple inner cowl 170 to partially constructed dome assembly 100 at each tab pair 214, 216 and 218.

With respect to outer cowl 190, each outer cowl slot 210 is substantially aligned with one tab pair 220, 222 or 224. More specifically, when slots 210 are aligned with tab pairs 220, 222 and 224, each protrusion 208 of outer cowl 190 is substantially aligned with one of the swirlers 162 and ring tabs 128 are also substantially aligned with outer cowl openings 206. As such, outer cowl 190 can be mechanically coupled to dome assembly ring 110 using, for example, bolts 226. More specifically, when cowl 190 is aligned with respect to assembly ring 110, a bolt 226 is inserted through each tab 128 and opening 206 interface such that cowl 190 is securely coupled to dome assembly ring 110 and to liner portions 130 and 150. Moreover, a cowl scallop 228 is used to couple outer cowl 190 to partially constructed dome assembly 100 at each tab pair 220, 222 and 224. Thus, slots 186 and 210 facilitate coupling inner cowl 170 and outer cowl 190, respectively, to partially constructed dome assembly 100. It should be appreciated that although the exemplary embodiment is described as mechanically coupling both inner cowl 170 and outer cowl 190 to dome assembly ring 110 using bolts 226, other embodiments may use any type of coupling means that enables dome assembly 100 to function as described herein. Coupling inner and outer cowls 170 and 190 to partially constructed dome assembly 100 completes construction of dome assembly 100. It should be appreciated that inner cowl 170 and outer cowl 190, upon coupling to dome assembly 100, together constitute a single cowl.

In another exemplary embodiment, dome assembly 100 may be completely assembled prior to coupling outer liner portion 150 to inner and outer liners 54 and 52, respectively. Moreover, after assembling dome assembly 100, dome assembly 100 is coupled to inner and outer liners 52 and 54 similar to the assembly methods as described above.

The above-described method and apparatus facilitates producing dome assemblies that may be installed in a combustor with minimal maintenance time. Specifically, the inner and outer cowls may be installed to facilitate their removal, thus providing easy access to the swirlers without requiring uncoupling the dome assembly ring from either the inner or outer liner portions. Specifically, inner and outer liners are coupled to a dome assembly ring using mechanical fasteners and then swirlers are positioned against the dome assembly ring. Slots in the inner and outer cowls are aligned to correspond with the mechanical fasteners and the cowls are coupled in place using mechanical fasteners. Inner and outer cowls have protrusions that function to facilitate maintaining swirlers in position. As a result, the inner and outer cowls may be easily removed, thus allowing quick and easy access for performing maintenance.

In one embodiment, a method of assembling a dome assembly for use in a turbine engine combustor is disclosed. The method includes providing a dome assembly ring, an inner liner portion and an outer liner portion, coupling the inner liner portion to the dome assembly ring and coupling the outer liner portion to the dome assembly ring to form a partially constructed dome assembly, providing a plurality of elongated rings and positioning each of the plurality of elongated rings on the dome assembly ring, and providing an inner cowl and an outer cowl. The method also includes coupling the inner and outer cowls to the dome assembly ring such that each of the plurality of elongated rings and the inner and outer cowls are removable without disassembling the dome assembly ring and the inner and outer liner portions.

In each embodiment the above-described method of assembling an annular dome assembly facilitates reducing the maintenance time required to replace component parts. More specifically, in each embodiment, the method facilitates reducing maintenance time by coupling the inner and outer liner portions to the dome assembly ring, and then coupling the inner and outer cowls to the dome assembly ring. As a result, mixers and cowls may be replaced without disassembling the dome or liner portions. Accordingly, turbine engine performance and component useful life are each facilitated to be enhanced in a cost effective and reliable manner.

Although the method and apparatus described herein are described in the context of positioning a dome assembly in a combustor of a gas turbine engine, it is understood that the method and apparatus are not limited to gas turbine engines or combustors. Likewise, the gas turbine engine and combustor liner components illustrated are not limited to the specific embodiments described herein, but rather, components of both the gas turbine engine and the combustor liner can be utilized independently and separately from other components described herein.

While the invention has been described in terms of various specific embodiments, those skilled in the art will recognize that the invention can be practiced with modification within the spirit and scope of the claims.

What is claimed is:

1. A method of assembling a dome assembly for use in a turbine engine combustor, said method comprising:

providing a dome assembly ring, an inner liner portion, and an outer liner portion;

coupling the inner liner portion and the outer liner portion to the dome assembly ring;

positioning a plurality of elongated rings on the dome assembly ring; and coupling at least one of an inner cowl including a plurality of slots and an outer cowl including a plurality of slots to the dome assembly ring such that each of the plurality of elongated rings and at least one of the inner and outer cowls are removable without uncoupling the dome assembly ring from either the inner or outer liner portions, wherein the slots are configured to couple the inner and outer liner portions to the dome assembly ring, providing an inner cowl including a plurality of slots and an outer cowl including a plurality of slots, wherein the slots are configured to couple the inner and outer liner portions to the dome assembly ring.

2. A method in accordance with claim 1 wherein coupling the inner liner portion to the dome assembly ring further comprises mechanically coupling the inner liner portion to the dome assembly ring at three coupling locations.

3. A method in accordance with claim 2 further comprising positioning the inner cowl against the dome assembly ring such that the at least three slots formed in the inner cowl substantially align with the three inner liner coupling locations.

4. A method in accordance with claim 2 further comprising positioning the outer cowl against the dome assembly ring such that the at least three slots formed in the outer cowl substantially align with the coupling locations defined in the outer cowl.

5. A method in accordance with claim 1 wherein coupling the outer liner portion to the dome assembly ring further comprises mechanically coupling the outer liner portion to the dome assembly ring at three coupling locations.

6. A method in accordance with claim 1 wherein providing an inner cowl and an outer cowl further comprises providing an inner cowl comprising a radially inner edge and a radially outer edge and forming the plurality of slots in the radially inner edge such that each of the plurality of slots extends from the radially inner edge to the radially outer edge.

7. A method in accordance with claim 1 wherein providing an inner cowl and an outer cowl further comprises providing an outer cowl comprising a radially inner edge and a radially outer edge and forming the plurality of slots in the radially inner edge such that each of the plurality of slots extends from the radially inner edge to the radially outer edge.

8. A method in accordance with claim 1 wherein coupling at least one of an inner cowl and an outer cowl to the dome assembly ring further comprises coupling the inner cowl and the outer cowl to the dome assembly ring such that the inner and outer cowls together constitute a single cowl.

9. A system for assembling a dome assembly for use in a turbine engine combustor, said system comprising:

a dome assembly ring, an inner liner portion, and an outer liner portion, said inner liner portion and said outer liner portion coupled to said dome assembly ring to form a partially-assembled dome assembly;

a plurality of elongated rings, each of said plurality of elongated rings coupled to said dome assembly ring; and at least one of an inner cowl and an outer cowl is coupled to said partially-constructed dome assembly such that each of said plurality of elongated rings and at least one of said inner and outer cowls is removable without uncoupling said partially-assembled dome assembly from either said inner or outer liner portions, said inner cowl comprising a radially inner edge and a radially outer edge and at least three slots positioned in said radially inner edge such that each of said slots extends from said radially inner edge towards said radially outer edge.

10. A system in accordance with claim 9 wherein said inner liner portion is coupled to said partially-assembled dome assembly at three inner liner coupling locations.

11. A system in accordance with claim 9 wherein said outer liner portion is coupled to said partially-assembled dome assembly at three outer liner coupling locations.

12. A system in accordance with claim 9 wherein said at least three slots substantially align with said three inner liner coupling locations.

13. A system in accordance with claim 9 wherein said inner cowl and said outer cowl are coupled to said dome assembly ring such that said inner and outer cowls constitute a single cowl.

14. A dome assembly for use in a turbine engine combustor, said dome assembly comprising:

a dome assembly ring, an inner liner portion, and an outer liner portion, said inner liner portion and said outer liner portion coupled to said dome assembly ring to form a partially-assembled dome assembly;

a plurality of elongated rings, each of said plurality of elongated rings coupled to said dome assembly ring; and at least one of an inner cowl and an outer cowl is coupled to said partially-constructed dome assembly such that each of said plurality of elongated rings and at least one of said inner and outer cowls is removable without uncoupling said partially-assembled dome assembly from either said inner or outer liner portions, said inner cowl comprising a radially inner edge and a radially outer edge and at least three slots positioned in said radially inner edge such that each of said slots extends from said radially inner edge towards said radially outer edge.

15. An assembly according to claim 14 wherein said inner liner portion is coupled to said partially-assembled dome assembly at three inner liner coupling locations.

16. An assembly according to claim 15 wherein said outer liner portion is coupled to said partially-assembled dome assembly at three outer liner coupling locations.

17. An assembly according to claim 16 wherein said outer cowl comprises:

a radially inner edge and a radially outer edge; and at least three slots positioned in said radially inner edge such that each of said slots extends from said radially inner edge towards said radially outer edge.

18. An assembly according to claim 17 wherein said at least three slots substantially align with said three outer liner coupling locations.

* * * * *